US006901973B1

(12) United States Patent
Hall et al.

(10) Patent No.: US 6,901,973 B1
(45) Date of Patent: Jun. 7, 2005

(54) PRESSURIZED LIQUID NATURAL GAS FILLING SYSTEM AND ASSOCIATED METHOD

(75) Inventors: Ivan Keith Hall, Mobile, AL (US); Justin Charles Gish, Mobile, AL (US)

(73) Assignee: Harsco Technologies Corporation, Fairmont, MN (US)

( * ) Notice: Subject to any disclaimer, the term of this patent is extended or adjusted under 35 U.S.C. 154(b) by 0 days.

(21) Appl. No.: 10/754,783

(22) Filed: Jan. 9, 2004

(51) Int. Cl.[7] ..... B65B 1/04
(52) U.S. Cl. ..... 141/82; 141/39
(58) Field of Search ..... 141/1–5, 12, 18, 141/71, 82, 83, 39, 40

(56) References Cited

U.S. PATENT DOCUMENTS 5,409,046 A * 4/1995 Swenson et al. ..... 141/11
5,479,966 A * 1/1996 Tison et al. ..... 141/4
5,505,232 A * 4/1996 Barclay ..... 141/11
5,538,051 A * 7/1996 Brown et al. ..... 141/18
5,687,776 A * 11/1997 Forgash et al. ..... 141/11
5,694,985 A * 12/1997 Diggins ..... 141/4

OTHER PUBLICATIONS

Taylor-Wharton Cryogenics, Auto-Fil Laser Pak (Convert Your Bulk Tank Into a High-Pressure, High-Flow Gas System, Apr. 2002, 1 page.

Taylor-Wharton, Auto-Fill Laser Pak Installation and Operation Manual, Revision A, Product Part No. AF55-9C00, pp. 1-29.

* cited by examiner

*Primary Examiner*—Steven O. Douglas
(74) *Attorney, Agent, or Firm*—David C. Jenkins; Eckert Seamans Cherin & Mellott, LLC

(57) ABSTRACT

A liquid natural gas filling system structured to store a cryogenic fluid at a low pressure and fill a use vessel at a high pressure. The filling system includes a first, low pressure vessel, at least one second, high pressure vessel, a plurality of conduits, each conduit in the plurality having a valve, extending between, and in fluid communication within the first, low pressure vessel and the at least one second, high pressure vessel, a pressure building means coupled to the at least one second, high pressure vessel and structured to raise the pressure of a cryogenic liquid within the at least one second, high pressure vessel, and an outlet nozzle structured to be coupled to a use vessel, the outlet nozzle coupled via the plurality of conduits to, and in fluid communication with, the first, low pressure vessel and the second, high pressure vessel. The filling system is structured so that a cryogenic liquid may be stored in the first, low pressure vessel at a low pressure. The cryogenic liquid at a low pressure may further be transferred to the at least one second, high pressure vessel via the plurality of conduits. The pressure of the cryogenic liquid at a low pressure in the at least one second, high pressure vessel may be increased to a high pressure by actuating the pressure building means. Thus, the cryogenic liquid at a high pressure in the at least one second, high pressure vessel may be transferred from the at least one second, high pressure vessel to a use vessel via the plurality of conduits and the nozzle.

17 Claims, 6 Drawing Sheets

PRESSURIZED LIQUID NATURAL GAS FILLING SYSTEM AND ASSOCIATED METHOD

BACKGROUND OF THE INVENTION

1. Field of the Invention

This invention relates to a liquid natural gas filling system and, more specifically, to a natural gas filling system having a low pressure vessel for holding a bulk quantity of liquid natural gas, and a high pressure vessel, for filling a use vessel, such as a fuel tank on a vehicle.

2. Background Information

There are an increased number of vehicles that use liquid natural gas (LNG) as a fuel. As such there is an increased need for filling systems to refuel the LNG vehicles and a need for such filling systems to hold an increased amount of fuel. It is understood that the pressure and temperature of a fluid in an enclosed space are related and that a higher pressure corresponds to higher temperature and a lower pressure corresponds to a lower temperature. Hereinafter, the pressure of the LNG will be identified as "high" or "low", it is understood that LNG at a lower pressure is also at a lower temperature. The fuel tank on an LNG vehicle is structured to hold the LNG at a pressure between about 75 psi to 125 psi. As used herein, this pressure shall be referred to as a "high" pressure. To contain the LNG, and any natural gas vapor, at such a high pressure, the LNG vehicle fuel tank is structurally robust. The manufacture of small vessels structured to contain LNG at a high pressure is not difficult or exceedingly expensive.

Presently, the filling systems for LNG vehicles include a bulk vessel that is structured to be coupled directly to the vehicle's LNG fuel tank. Because the bulk vessel is coupled directly to the fuel tank, the LNG in the bulk vessel must be maintained at a pressure similar to the pressure of the LNG fuel tank. As such, the bulk vessel must be constructed to hold a large quantity of LNG at a high pressure. Construction of such a vessel is not inexpensive. It is desirable to be able to store the bulk LNG at a lower pressure to reduce the cost of the bulk LNG vessel.

There is, therefore, a need for a LNG filling system that stores the bulk LNG at a lower pressure while delivering high pressure LNG to a vehicle.

There is a further need for a LNG filling system that stores the bulk LNG at a lower pressure while delivering high pressure LNG to a vehicle which may be used to fill multiple vehicles in rapid succession.

SUMMARY OF THE INVENTION

These needs, and others, are met by the invention which provides a liquid natural gas filling system having a first, low pressure vessel and at least one second, high pressure vessel. The low pressure vessel is, preferably a bulk vessel. The high pressure vessel is sized to fill the fuel tank on a LNG vehicle. The LNG in the low pressure vessel is transferred to the high pressure vessel where the pressure of the LNG is increased. Once the LNG is at a high pressure, the LNG is transferred to the vehicle fuel tank.

In a preferred embodiment, the liquid natural gas filling system is structured to deliver a small quantity of low pressure LNG to the vehicle fuel tank. This small quantity of low pressure LNG collapses the pressure head in the vehicle fuel tank and facilitates filling with the high pressure LNG.

This also reduces the saturation temperature of the filled tank and allows for a longer hold time before venting is required.

In another embodiment, there is a third, high pressure vessel which is substantially similar to the second, high pressure vessel. In this system, LNG from the first, low pressure vessel is delivered to alternate high pressure vessels so that one of the high pressure vessels is ready to fill a vehicle even after the other high pressure vessel has just completed a fill operation.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
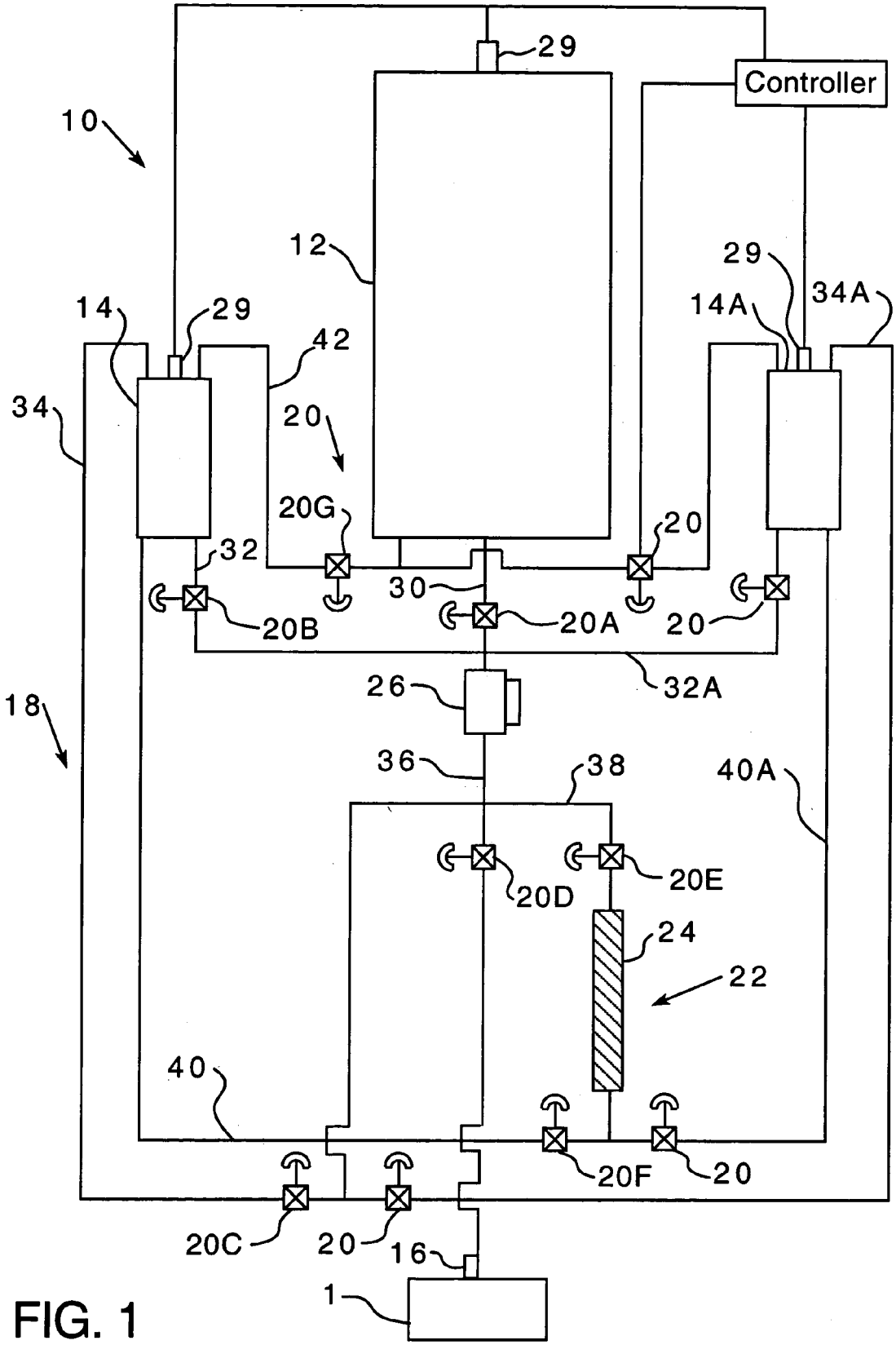
FIG. 1 is a schematic view of the filling system of the present invention.

As shown in FIG. 1, a liquid natural gas filling system 10 includes a first, low pressure vessel 12, at least one second, high pressure vessel 14, a nozzle 16 structured to be coupled to a LNG vehicle fuel tank, a plurality of conduits 18 coupling, and providing fluid communication between, the first, low pressure vessel 12, the at least one second, high pressure vessel 14, and the nozzle 16. The first, low pressure vessel 12 is structured to hold a cryogenic liquid saturated at a pressure between about 10 and 100 psi, and more preferably at about 20 psi. The first, low pressure vessel 12 is also structured to hold a bulk quantity of cryogenic liquid, preferably between about 13,000 and 20,000 gallons of cryogenic liquid, and more preferably about 16,000 gallons of cryogenic liquid. The at least one second, high pressure vessel 14 is structured to hold a cryogenic liquid saturated at a pressure between about 90 and 125 psi, and more preferably at about 100 psi. The at least one second, high pressure vessel 14 is also structured to hold a limited quantity of cryogenic liquid, preferably between about 100 and 500 gallons of cryogenic liquid, and more preferably about 220 gallons of cryogenic liquid.

Each of the conduits in the plurality of conduits 18 has a valve 20 thereon. Each valve 20 is structured to be moved between a first, closed position and a second, open position. When a valve 20 is in the first, closed position, fluid does not pass through the conduit associated with the valve 20. Conversely, when a valve 20 is in the second, open position, fluid may pass through the conduit associated with the valve 20. As set forth below, each valve 20 will be identified individually by the reference number "20" followed by a letter. For example, valve 20A is coupled to, and controls fluid flow through, the first, low pressure vessel liquid outlet conduit 30.

The plurality of conduits 18 include at least the following conduits; a first, low pressure vessel liquid outlet conduit 30, a second, high pressure vessel liquid outlet conduit 32, and a second, high pressure vessel liquid inlet conduit 34. The first, low pressure vessel liquid outlet conduit 30 and the second, high pressure vessel liquid outlet conduit 32 are, preferably, coupled, and in fluid communication, thereby forming a nozzle conduit 36. The nozzle 16 is disposed at, and is in fluid communication with, the distal end of the nozzle conduit 36. The second, high pressure vessel liquid inlet conduit 34 extends between, and is in fluid communication with both, the nozzle conduit 36 and the second, high pressure vessel 14. The valves 20A, 20B, 20C, and 20D are associated with the following respective conduits; the first, low pressure vessel liquid outlet conduit 30, the second, high pressure vessel liquid outlet conduit 32, the second, high pressure vessel liquid inlet conduit 34, and the nozzle conduit 36.

The a liquid natural gas filling system 10 also includes a pressure building means 22 structured to raise the saturation pressure of the cryogenic liquid from the pressure of the first, low pressure vessel 12 to the pressure of the second, high pressure vessel 14. The pressure building means 22 may be, but is not limited to, a device such as a vessel heater attached to the second, high pressure vessel 14. However, in the preferred embodiment, the pressure building means 22 is a vaporizer 24. A vaporizer conduit 38, having valve 20E thereon, extends between, and is in fluid communication with both, the nozzle conduit 36 and the vaporizer 24. A second, high pressure vessel vapor inlet conduit 40, having valve 20F thereon, extends between, and is in fluid communication with both, the vaporizer 24 and the second, high pressure vessel 14.

A second, high pressure vessel vapor outlet conduit 42 may extend between, and be in fluid communication with both, the second, high pressure vessel 14 and the first, low pressure vessel 12. Valve 20G is associated with the second, high pressure vessel vapor outlet conduit 42.

The liquid natural gas filling system 10 also includes a pump assembly 26. The pump assembly 26 is disposed on, and in fluid communication with, the nozzle conduit 36. The pump assembly 26 is, preferably, disposed upstream of the juncture of the nozzle conduit 36 and the vaporizer conduit 38. The pump assembly 26 is structured to accelerate the speed of the fluid flow through the nozzle conduit 36.

The liquid natural gas filling system 10 also includes an electronic control system 28. The electronic control system 28 is coupled to a plurality of sensors 29 as well as each of the valves 20. The sensors 29 are, preferably, disposed on each vessel 12, 14 and are structured to monitor temperature and pressure. The electronic control system 28 is further structured to control the position of each valve 20 and thereby control the flow of fluid through the liquid natural gas filling system 10.

There may also be a third, high pressure vessel 14A. The third, high pressure vessel 14A is substantially similar to the second, high pressure vessel 14 in size and structure. The third, high pressure vessel 14A includes a third, high pressure vessel liquid outlet conduit 32A, the third, high pressure vessel liquid inlet conduit 34A. The third, high pressure vessel liquid outlet conduit 32A is coupled to, and in fluid communication with, the second, high pressure vessel liquid outlet conduit 32. Similarly, the third, high pressure vessel liquid inlet conduit 34A is coupled to, and in fluid communication with, the second, high pressure vessel liquid inlet conduit 34. The third, high pressure vessel 14A preferably includes a third, high pressure vessel vapor inlet conduit 40A. The third, high pressure vessel vapor inlet conduit 40A is coupled to, and in fluid communication with, the second, high pressure vessel vapor inlet conduit 40. The third, high pressure vessel 14A also preferably includes a third, high pressure vessel vapor outlet conduit 42A. The third, high pressure vessel vapor outlet conduit 42A is coupled to, and in fluid communication with, the second, high pressure vessel vapor outlet conduit 42.

Figure 2:
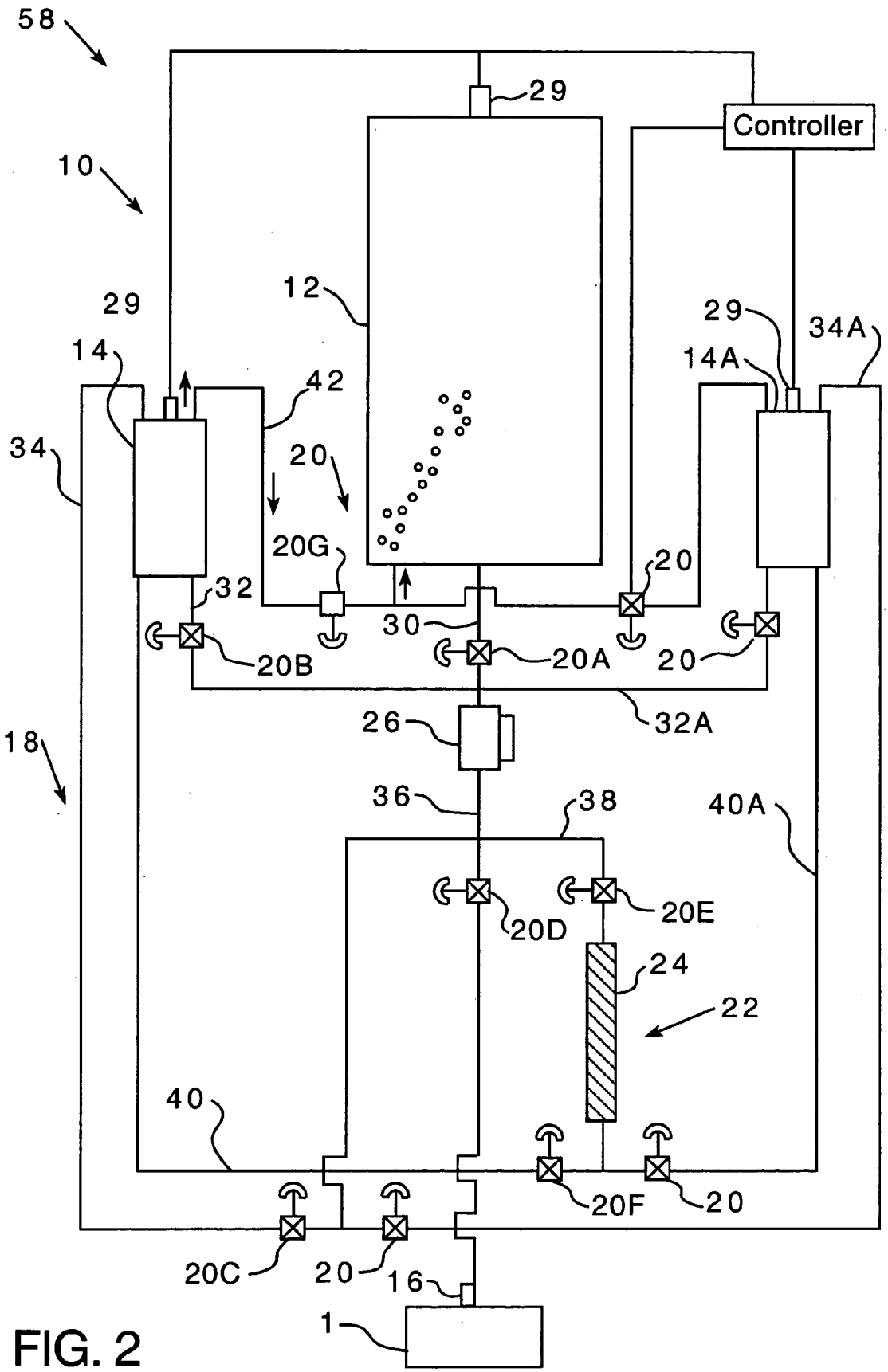
FIG. 2 is a schematic view of the filling system of the present invention showing the fluid flow during a venting step.
Figure 3:
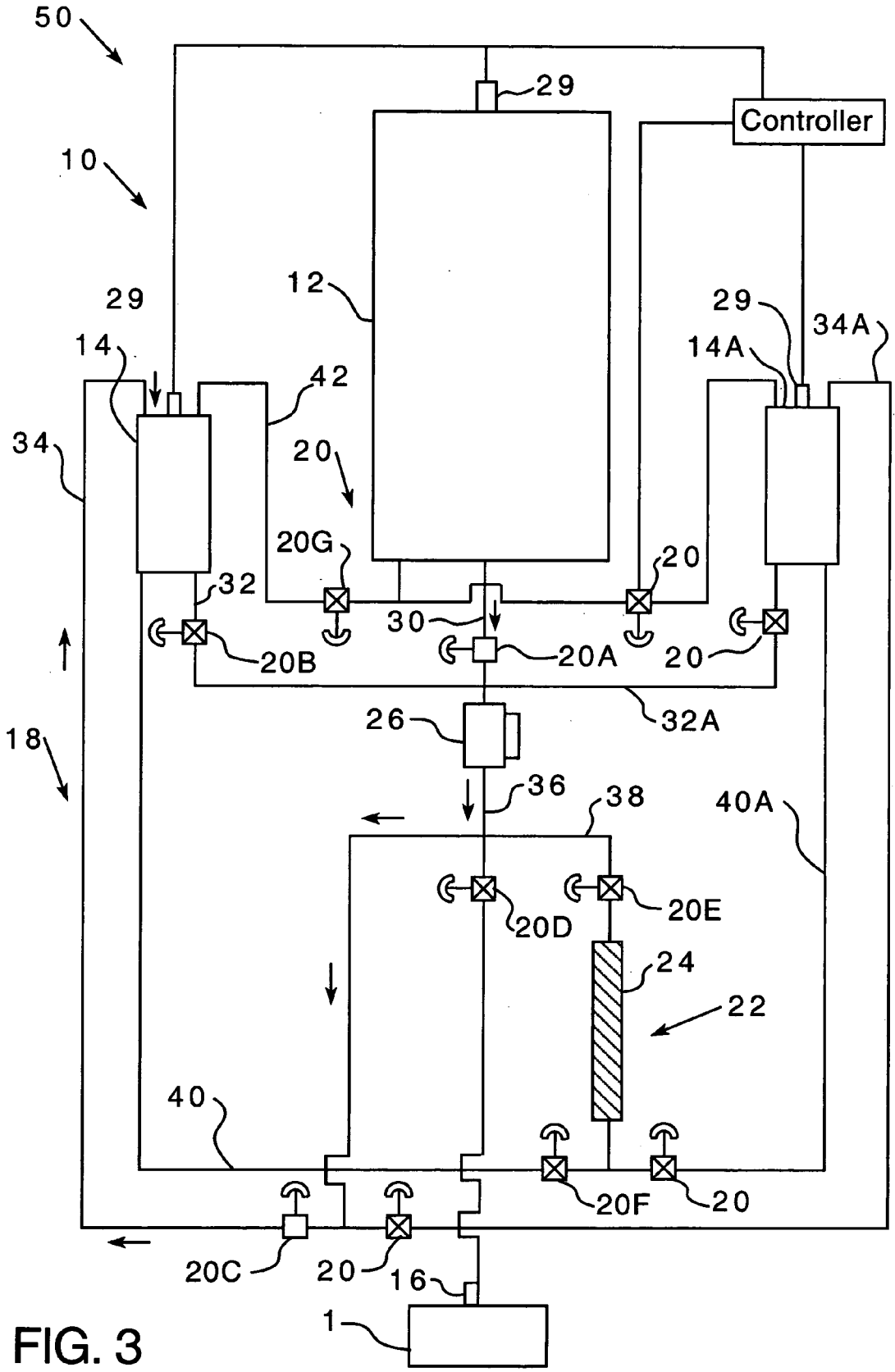
FIG. 3 is a schematic view of the filling system of the present invention showing the fluid flow during a transferring step.
Figure 4:
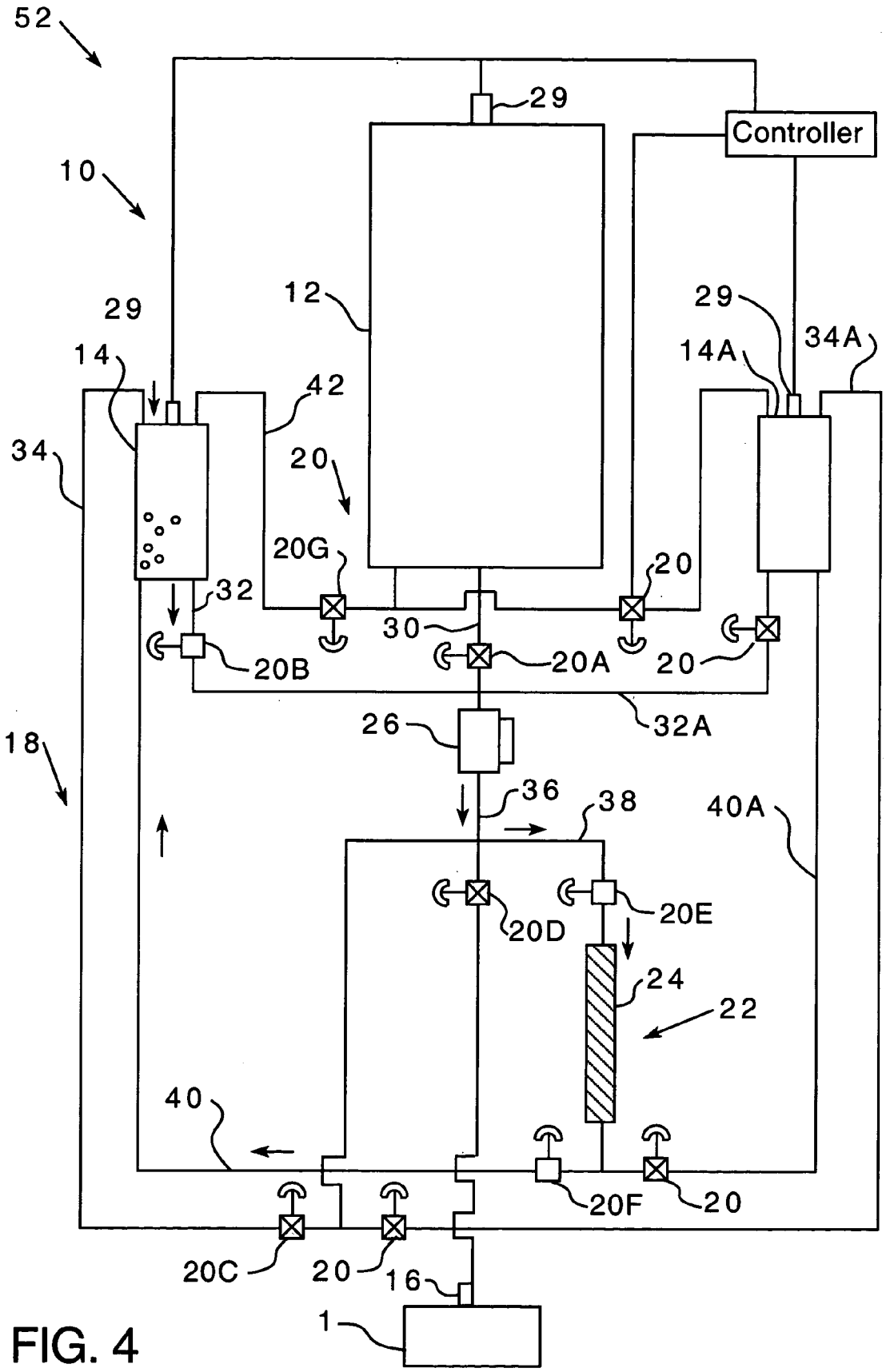
FIG. 4 is a schematic view of the filling system of the present invention showing the fluid flow during a pressurizing step.
Figure 5:
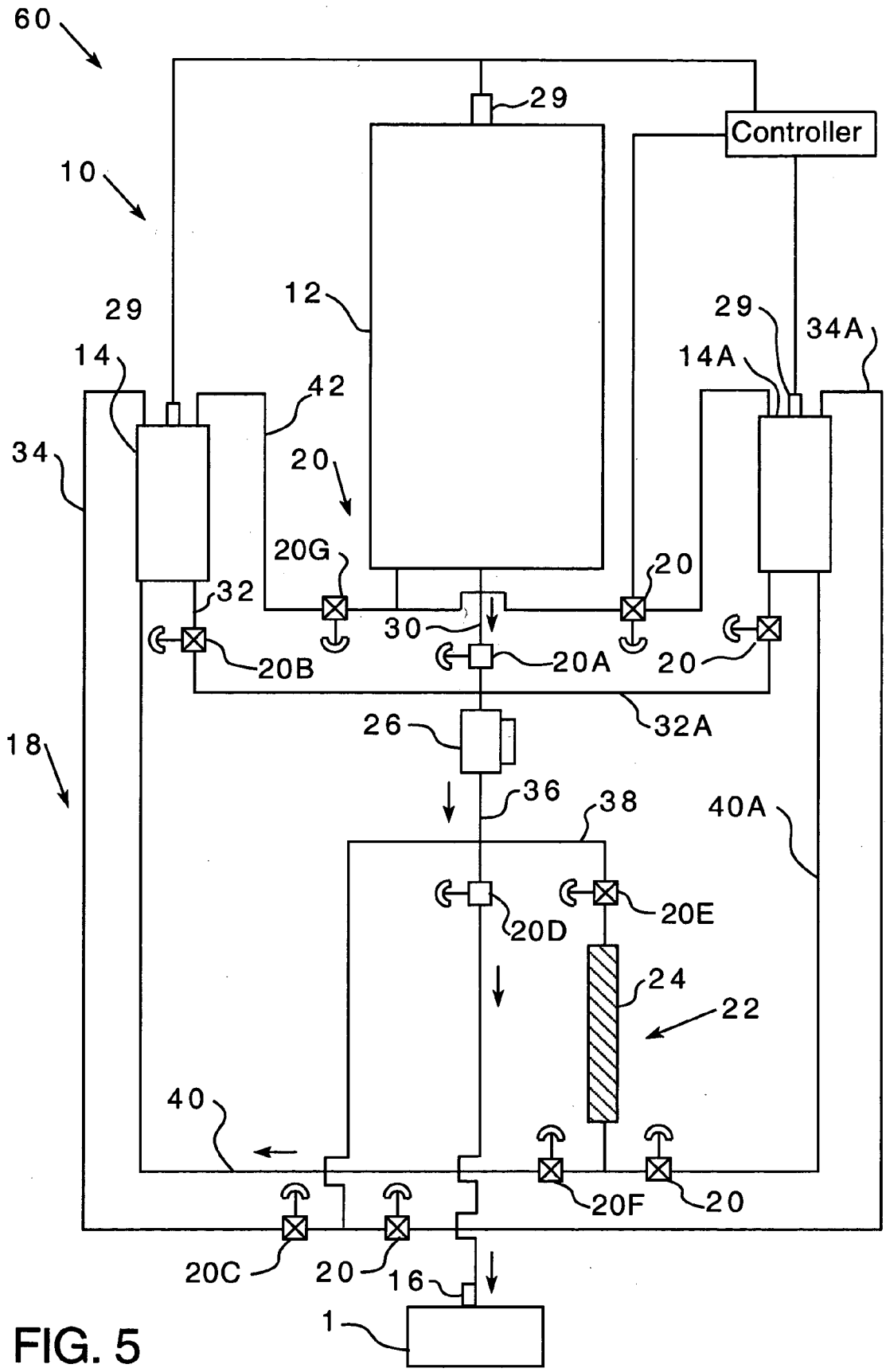
FIG. 5 is a schematic view of the filling system of the present invention showing the fluid flow during a low pressure filling step.
Figure 6:
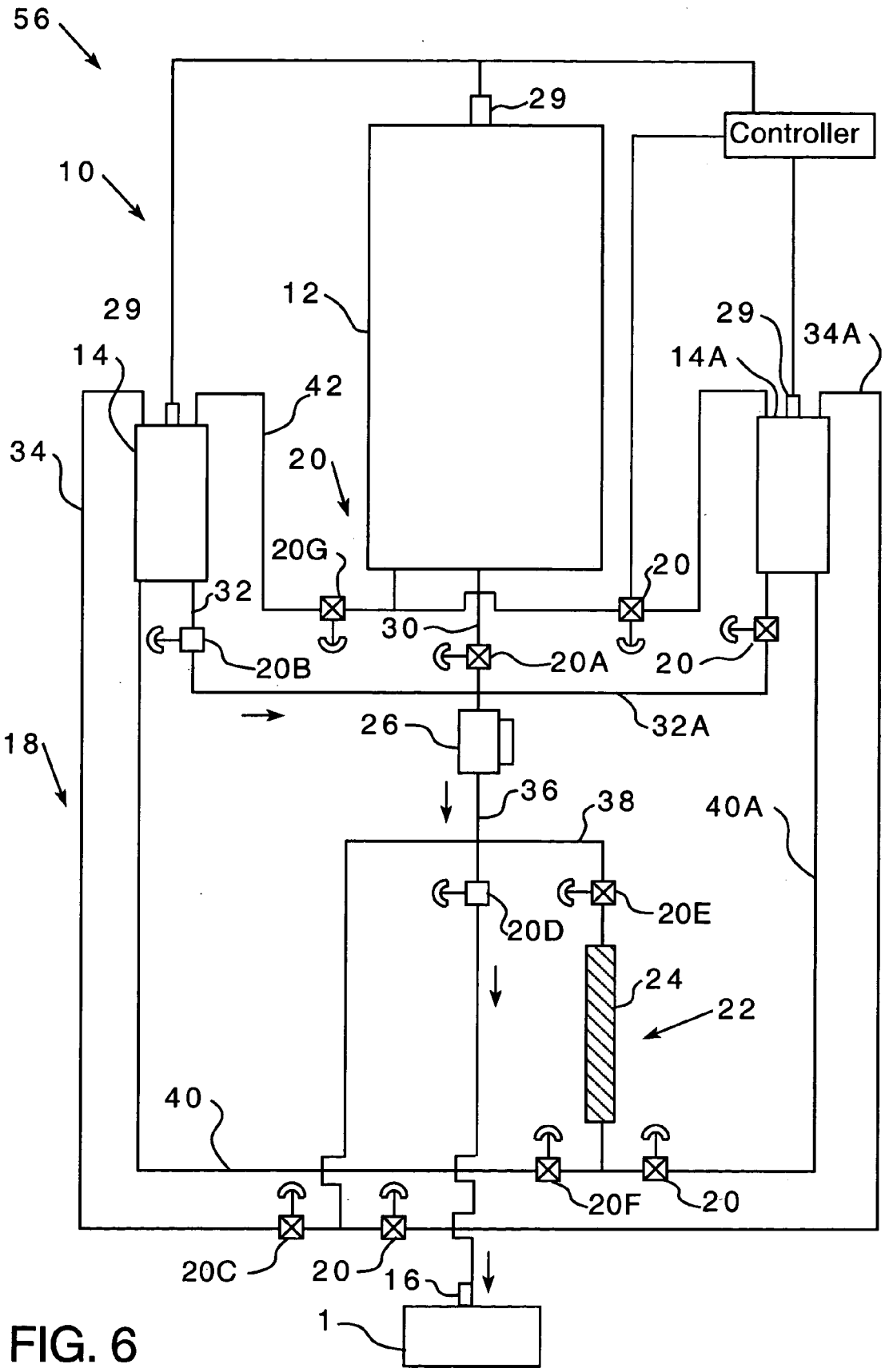
FIG. 6 is a schematic view of the filling system of the present invention showing the fluid flow during a high pressure filling step.

The operation of the filling station 10 occurs as follows. As shown in FIGS. 3, 4, and 6, there are at least three steps to a filling operation; a transfer step 50 (FIG. 3), wherein fluid is transferred from the first low, pressure vessel 12 to the second, high pressure vessel 14, a pressurizing step 52 (FIG. 4), wherein the pressure of the cryogenic liquid in the second, high pressure vessel 14 is raised from the low pressure to a high pressure, and a filling step 56 (FIG. 6) wherein the high pressure cryogenic liquid is transferred to an external vessel, such a vehicle fuel tank 1. The following optional steps may also occur. As shown in FIG. 2, the second, high pressure vessel 14 may be vented 58 to reduce the internal pressure. As shown in FIG. 5, a small amount of cryogenic liquid from the first, low pressure vessel 12 may be transferred to the external vessel during a low pressure filling step 60.

These steps are performed as follows. It is assumed for the sake of this example that all valves 20 are initially in the first, closed position and that the nozzle 16 is coupled to a vehicle fuel tank 1. If the second, high pressure vessel 14 has recently been used, the second, high pressure vessel 14 may still contain residual cryogenic liquid and vapor at the high pressure. Thus, as shown in FIG. 2, the second, high pressure vessel vapor outlet conduit valve 20G is opened to allow the high pressure vapor to be vented 58 to the first, low pressure vessel 12. Once the pressure in both the first, low pressure vessel 12 and the second, high pressure vessel 14 have reached equilibrium, the second, high pressure vessel vapor outlet conduit valve 20G is closed. Due to the relative size of the vessels 12, 14 the pressure at equilibrium will be substantially close to the nominal pressure of the first, low pressure vessel 12.

Once the pressure in the second, high pressure vessel 14 has been reduced, cryogenic liquid is transferred 50 from the first, low pressure vessel 12 to the second, high pressure vessel 14. That is the first, low pressure vessel liquid outlet conduit valve 20A is opened and allows low pressure cryogenic fluid to flow though the first, low pressure vessel liquid outlet conduit 30, the nozzle conduit 36, the second, high pressure vessel liquid inlet conduit 34, and into the second, high pressure vessel 14. The flow may be accelerated by the pump assembly 26 at the nozzle conduit 36. Once the second, high pressure vessel 14 is sufficiently filled with low pressure cryogenic liquid, the first, low pressure vessel liquid outlet conduit valve 20A is closed.

As shown in FIG. 4, to pressurize the second, high pressure vessel 14, the pressure building means 22 is actuated. To accomplish this, during the step of pressurizing 52 the second, high pressure vessel 14, the second, high pressure vessel liquid outlet conduit valve 20B, the vaporizer conduit valve 20E, and the second, high pressure vessel vapor inlet conduit valve 20F are opened. Thus, a portion of the low pressure cryogenic liquid in the second, high pressure vessel 14 may flow through the second, high pressure vessel liquid outlet conduit 32, the nozzle conduit 36, the vaporizer conduit 38, and into the vaporizer 24. The flow may be accelerated by the pump assembly 26 at the nozzle conduit 36. Within the vaporizer 24, the low pressure cryogenic liquid is evaporated and becomes a vapor. The vapor is transferred through the second, high pressure vessel vapor inlet conduit 40 into the second high pressure vessel 14. Preferably, the vapor is bubbled up through the low pressure liquid within the second high pressure vessel 14 to effect a transfer of heat. The introduction of the high pressure vapor to the second high pressure vessel 14 raises the pressure of the cryogenic liquid within the second high pressure vessel 14. Once the fluid within the second, high pressure vessel 14 is at or about the high pressure, the second, high pressure vessel liquid outlet conduit valve 20B, the vaporizer conduit valve 20E and the second, high pressure vessel vapor inlet conduit valve 20F are closed.

As shown in FIG. 5, a small quantity of low pressure cryogenic liquid from the first, low pressure vessel 12 may be transferred to the vehicle fuel tank 1. As used herein, a "small quantity" shall mean between about 5 and 10 gallons of cryogenic liquid. The low pressure cryogenic liquid in the vehicle fuel tank 1 will cause the pressure head within the vehicle fuel tank to collapse. This facilitates filling the vehicle fuel tank 1 with the high pressure cryogenic liquid from the second, high pressure vessel 14. During the low pressure filling step 60 the first, low pressure vessel liquid outlet conduit valve 20A and the nozzle conduit valve 20D are opened. Low pressure cryogenic liquid may then flow though the first, low pressure vessel liquid outlet conduit 30, the pump assembly 26, the nozzle conduit 36 and the nozzle 16 into the vehicle fuel tank 1. Once a sufficient quantity of low pressure cryogenic liquid has been transferred to the vehicle fuel tank 1, the first, low pressure vessel liquid outlet conduit valve 20A and the nozzle conduit valve 20D are closed. The flow may be accelerated by the pump assembly 26 at the nozzle conduit 36.

As shown in FIG. 6, during the filling step 56, cryogenic liquid at a high pressure is transferred from the second, high pressure vessel 14 to the vehicle fuel tank 1. This is accomplished by opening the second, high pressure vessel liquid outlet conduit valve 20B and the nozzle conduit valve 20D. This allows the high pressure cryogenic liquid from the second, high pressure vessel 14 to flow through the second, high pressure vessel liquid outlet conduit 32, the nozzle conduit 36, the nozzle 16 and into the vehicle fuel tank 1. After the vehicle fuel tank 1 is filled, the second, high pressure vessel liquid outlet conduit valve 20B and the nozzle conduit valve 20D are closed, thereby returning the system to the original configuration.

When the liquid natural gas filling system 10 includes the third, high pressure vessel 14A, different steps of the filling procedure may occur simultaneously, or alternately, with respect to the different high pressure vessels 14, 14A. That is, for example, the third, high pressure vessel 14A may be vented 58 while the second, high pressure vessel 14 is being pressurized 52. Thus, the third, high pressure vessel 14A may be filled and pressurized and ready to fill another vehicle fuel tank 1 while the second, high pressure vessel 14 is in use. By charging the high pressure vessels 14, 14A alternately, there is always one high pressure vessel 14, 14A ready to be used.

While specific embodiments of the invention have been described in detail, it will be appreciated by those skilled in the art that various modifications and alternatives to those details could be developed in light of the overall teachings of the disclosure. For example, the filling system 10 has been described as having vessels 12, 14, 14A structured to hold LNG. The filling system 10 may also be used with other cryogenic liquids. Additionally, it is understood that the filling system 10 includes addition pressure relief valves, burst disks, and other safety devices disposed on each vessel, conduit, or other component. Accordingly, the particular arrangements disclosed are meant to be illustrative only and not limiting as to the scope of invention which is to be given the full breadth of the claims appended and any and all equivalents thereof.

What is claimed is:

1. A liquid natural gas filling system comprising:

a first, low pressure vessel;

a second, high pressure vessel;

a third, high pressure vessel;

a plurality of conduits, each conduit in said plurality having a valve, extending between, and in fluid communication within said first, low pressure vessel and said at least one second, high pressure vessel;

a pressure building means coupled to said at least one second, high pressure vessel and structured to raise the pressure of a cryogenic liquid within said at least one second, high pressure vessel;

an outlet nozzle structured to be coupled to a use vessel, said outlet nozzle coupled via said plurality of conduits to, and in fluid communication with, said first, low pressure vessel, said second, high pressure vessel and said third, high pressure vessel; and whereby a cryogenic liquid may be stored in said first, low pressure vessel at a low pressure, said cryogenic liquid at a low pressure may be further transferred to either said second, high pressure vessel or said third, high pressure vessel via said plurality of conduits, the pressure of said cryogenic liquid at a low pressure in said second, high pressure vessel or said third, high pressure vessel may be increased to a high pressure by actuating said pressure building means, and said cryogenic liquid at a high pressure in said second, high pressure vessel or said third, high pressure vessel may be transferred from said second, high pressure vessel or said third, high pressure to a use vessel via said plurality of conduits and said nozzle.

2. The liquid natural gas filling system of claim 1, wherein said pressure building means is a vaporizer.

3. The liquid natural gas filling system of claim 2, further comprising a pump assembly coupled to one conduit of said plurality of conduits and structured to accelerate the flow of fluid through said conduits.

4. The liquid natural gas filling system of claim 3, wherein said pump assembly is disposed on said nozzle conduit.

5. The liquid natural gas filling system of claim 2, wherein said plurality of conduits includes:

a first, low pressure vessel liquid outlet conduit coupled to, and in fluid communication with, said first, low pressure vessel;

a second, high pressure vessel liquid inlet conduit coupled to, and in fluid communication with, said second, high pressure vessel;

a second, high pressure vessel liquid outlet conduit coupled to, and in fluid communication with, said second, high pressure vessel;

said first, low pressure vessel liquid outlet conduit and said second, high pressure vessel liquid outlet conduit coupled, and in fluid communication, thereby forming a nozzle conduit; and said nozzle conduit coupled to, and in fluid communication with, said nozzle;

said nozzle conduit coupled to, and in fluid communication with, said second, high pressure vessel liquid inlet conduit.

6. The liquid natural gas filling system of claim 5, wherein said plurality of conduits further includes:

a second, high pressure vessel vapor outlet conduit coupled to, and in fluid communication with, said second, high pressure vessel and said vaporizer; and a vaporizer conduit coupled to, and in fluid communication with, said second, high pressure vessel liquid outlet conduit and said vaporizer.

7. The liquid natural gas filling system of claim 6, wherein said plurality of conduits includes:

a third, high pressure vessel liquid inlet conduit coupled to, and in fluid communication with, said third, high pressure vessel and said second, high pressure vessel liquid inlet conduit;

a third, high pressure vessel liquid outlet conduit coupled to, and in fluid communication with, said at least one second, high pressure vessel and said second, high pressure vessel liquid outlet conduit; and said third, high pressure vessel liquid outlet conduit coupled to, and in fluid communication with, said nozzle conduit.

8. The liquid natural gas filling system of claim 1, wherein said plurality of conduits includes:

a first, low pressure vessel liquid outlet conduit coupled to, and in fluid communication with, said first, low pressure vessel;

a second, high pressure vessel liquid inlet conduit coupled to, and in fluid communication with, said second, high pressure vessel;

a second, high pressure vessel liquid outlet conduit coupled to, and in fluid communication with, said second, high pressure vessel;

said first, low pressure vessel liquid outlet conduit and said second, high pressure vessel liquid outlet conduit coupled to, and in fluid communication, thereby forming a nozzle conduit; and said nozzle conduit coupled to, and in fluid communication with, said nozzle;

said nozzle conduit coupled to, and in fluid communication with, said second, high pressure vessel liquid inlet conduit.

9. The liquid natural gas filling system of claim 8, wherein said plurality of conduits further includes:

a second, high pressure vessel vapor inlet conduit coupled to, and in fluid communication with, said second, high pressure vessel and said vaporizer; and a vaporizer conduit coupled to, and in fluid communication with, said second, high pressure vessel liquid outlet conduit and said vaporizer.

10. The liquid natural gas filling system of claim 9, wherein said pump assembly is disposed on said nozzle conduit.

11. The liquid natural gas filling system of claim 10, wherein said plurality of conduits includes:

a third, high pressure vessel liquid inlet conduit coupled to, and in fluid communication with, said third, high pressure vessel and said second, high pressure vessel liquid inlet conduit;

a third, high pressure vessel liquid outlet conduit coupled to, and in fluid communication with, said at least one second, high pressure vessel and said second, high pressure vessel liquid outlet conduit; and said third, high pressure vessel liquid outlet conduit coupled to, and in fluid communication with, said nozzle conduit.

12. The liquid natural gas filling system of claim 1, further comprising an electronic control system, said electronic control system coupled to each valve on said plurality of conduits and structured to move said valves from a first, closed position to a second, open position.

13. A method of filling a vehicle fuel tank with a cryogenic liquid comprising the steps of:

providing a first, low pressure vessel containing a cryogenic liquid at a low pressure, at least one second, high pressure vessel, a plurality of conduits, each conduit in said plurality having a valve, extending between, and in fluid communication within said first, low pressure vessel and said at least one second, high pressure vessel, a pressure building means coupled to said at least one second, high pressure vessel and structured to raise the pressure of a cryogenic liquid within said at least one second, high pressure vessel, and an outlet nozzle structured to be coupled to said vehicle fuel tank, said outlet nozzle coupled via said plurality of conduits to, and in fluid communication with, said first, low pressure vessel and said second, high pressure vessel;

transferring a quantity of cryogenic liquid at a low pressure from said first, low pressure vessel to said at least one second, high pressure vessel;

raising the pressure of the cryogenic liquid in said at least one second, high pressure vessel by actuating said pressure building means;

filling said vehicle fuel tank by transferring said cryogenic liquid at a high pressure from said at least one second, high pressure vessel to said vehicle fuel tank;

providing a third, high pressure vessel coupled via said conduits to said first, low pressure assembly, said vaporizer, and said nozzle;

transferring a quantity of cryogenic liquid at a low pressure from said first, low pressure vessel to said third, high pressure vessel;

raising the pressure of the cryogenic liquid in said third, high pressure vessel by actuating said pressure building means; and filling another vehicle fuel tank by transferring said cryogenic liquid at a high pressure from said third, high pressure vessel to said vehicle fuel tank.

14. The method of claim 13 wherein, prior to said step of filling said vehicle fuel tank, the method includes the step of:

transferring a small quantity of low pressure cryogenic fluid from said first, low pressure vessel to said vehicle fuel tank.

15. The method of claim 13 wherein, prior to said step of transferring a quantity of cryogenic liquid at a low pressure from said first, low pressure vessel to said at least one second, high pressure vessel, the method includes the step of:

venting fluid from said at least one second, high pressure vessel.

16. The method of claim 15 wherein fluid vented from said at least one second, high pressure vessel is transferred to said first, low pressure vessel.

17. The method of claim 13 wherein, said method includes the further steps of:

providing a pump assembly structured to increase the speed of fluid transfer; and pumping said cryogenic liquid at a high pressure from said at least one second, high pressure vessel to said vehicle fuel tank.

* * * * *